US010947072B2

(12) United States Patent
Nakajima

(10) Patent No.: US 10,947,072 B2
(45) Date of Patent: Mar. 16, 2021

(54) BELT CONVEYING DEVICE AND IMAGE FORMING APPARATUS

(71) Applicant: CANON KABUSHIKI KAISHA, Tokyo (JP)

(72) Inventor: Takao Nakajima, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 228 days.

(21) Appl. No.: 15/912,337

(22) Filed: Mar. 5, 2018

(65) Prior Publication Data

US 2018/0257885 A1 Sep. 13, 2018

(30) Foreign Application Priority Data

Mar. 7, 2017 (JP) ..... JP2017-042931

(51) Int. Cl.

| | |
|---|---|
| ***B65H 5/02*** | (2006.01) |
| ***G03G 15/00*** | (2006.01) |
| ***G03G 15/02*** | (2006.01) |
| ***G03G 15/16*** | (2006.01) |

(52) U.S. Cl.

CPC ..... *B65H 5/026* (2013.01); *G03G 15/02* (2013.01); *G03G 15/1615* (2013.01); *G03G 15/6555* (2013.01); *B65H 2404/25* (2013.01); *G03G 2215/00156* (2013.01)

(58) Field of Classification Search

CPC ..... G03G 15/1615; G03G 15/754; G03G 2215/00156; G03G 2215/00139; G03G 2215/00143; B65H 2404/25; B65H 2404/251; B65H 2404/253; B65H 2404/255; B65H 2404/262; B65H 2215/00139; B65H 2215/00143

See application file for complete search history.

(56) References Cited

U.S. PATENT DOCUMENTS

| | | | | |
|---|---|---|---|---|
| 2007/0071486 | A1 | 3/2007 | Chiba | |
| 2008/0124120 | A1* | 5/2008 | Kang | G03G 15/16 399/121 |
| 2013/0084110 | A1* | 4/2013 | Fujioka | G03G 15/16 399/312 |

(Continued)

FOREIGN PATENT DOCUMENTS

| | | | |
|---|---|---|---|
| CN | 101221396 | A | 7/2008 |
| CN | 105022248 | A | 11/2015 |

(Continued)

*Primary Examiner* — Jennifer E Simmons
*Assistant Examiner* — Quang X Nguyen
(74) *Attorney, Agent, or Firm* — Canon U.S.A., Inc. IP Division

(57) ABSTRACT

An inadvertent swing of a steering roller is restricted with a versatile configuration. A belt conveying device includes a belt member configured to be stretched around a steering roller and a roller member, and a movement mechanism configured to move the roller member. The roller member is movable to a first position and a second position where the roller member is moved further inward on an inner peripheral side of the belt member than the first position by the movement mechanism. In the movement mechanism, a restriction portion capable of restricting a swinging range of the steering roller more in a case where the roller member is at the second position than in a case where the roller member is at the first position is provided.

19 Claims, 11 Drawing Sheets

(56) References Cited

U.S. PATENT DOCUMENTS

| | | | | |
|---|---|---|---|---|
| 2014/0183008 | A1 | 7/2014 | Yasumoto | |
| 2015/0346648 | A1* | 12/2015 | Kudo | G03G 15/16 399/121 |

FOREIGN PATENT DOCUMENTS

| | | | |
|---|---|---|---|
| CN | 102375383 | A | 12/2015 |
| JP | 2008-309941 | A | 12/2008 |
| JP | 2012-242554 | A | 12/2012 |
| JP | 2013-120260 | A | 6/2013 |
| JP | 2015-225185 | A | 12/2015 |

* cited by examiner

BELT CONVEYING DEVICE AND IMAGE FORMING APPARATUS

BACKGROUND OF THE INVENTION

Field of the Invention

The present disclosure relates to a belt conveying device for conveying an endless belt, and an image forming apparatus including the belt conveying device.

Description of the Related Art

Conventionally, in an image forming apparatus using an electrophotographic method, the configuration of the following intermediate transfer method is known. In the intermediate transfer method, a toner image formed on a photosensitive member is primarily transferred onto an intermediate transfer belt, and the toner image borne on the intermediate transfer belt is further secondarily transferred onto a recording material. Further, in an image forming apparatus using an intermediate transfer method, the following configuration is known. In this configuration, to reduce the deviation or the meandering of an intermediate transfer belt, a steering roller for steering the intermediate transfer belt, i.e., controlling the position in the width direction of the intermediate transfer belt, is placed.

Japanese Patent Application Laid-Open No. 2012-242554 discusses a configuration in which a steering roller and a cam capable of swinging a roller shaft of the steering roller by being driven by a motor are included, and a restriction portion capable of being fit to the roller shaft is provided in part of the cam. In this configuration, in a case where an intermediate transfer belt is replaced, the restriction portion is fit to the roller shaft, thereby preventing the roller shaft and the cam from colliding with each other due to the swing of the steering roller when the work of replacing the intermediate transfer belt is performed.

However, the configuration discussed in Japanese Patent Application Laid-Open No. 2012-242554 is based on the premise that the steering roller is swung by the cam of which the phase can be controlled by an actuator such as a motor. Thus, it is difficult to implement the configuration depending on the mechanism of steering. For example, in a configuration in which a steering roller or a member for swinging integrally with the steering roller passively swings by a force received from an intermediate transfer belt, a cam including the above restriction portion needs to be newly provided. This leads to an increase in the cost.

SUMMARY OF THE INVENTION

The present disclosure is directed to providing a belt conveying device capable of restricting an inadvertent swing of a steering roller with a versatile configuration, and an image forming apparatus including the belt conveying device.

According to an aspect of the present, a belt unit attachable to and detachable from an image forming apparatus includes an endless belt, a steering mechanism including a first roller around which the belt is stretched, the steering mechanism capable of swinging the first roller about a swing axis intersecting an axial direction of the first roller; a second roller around which the belt is stretched, and movable to a first position and a second position, a frame configured to movably support the second roller, and a movement mechanism provided to be movable relative to the frame and configured to move the second roller, wherein the movement mechanism includes a restriction portion configured to restrict a swing of the first roller, and in a case where the second roller is at the first position, the first roller is provided to be swingable in a first predetermined range, and in a case where the second roller is at the second position, the restriction portion restricts the swing of the first roller within a second predetermined range smaller than the first predetermined range by contacting the first roller.

Further features of the present disclosure will become apparent from the following description of exemplary embodiments with reference to the attached drawings.

DESCRIPTION OF THE EMBODIMENTS

With reference to the drawings, a belt conveying device and an image forming apparatus according to the present disclosure will be described below.

Figure 1:
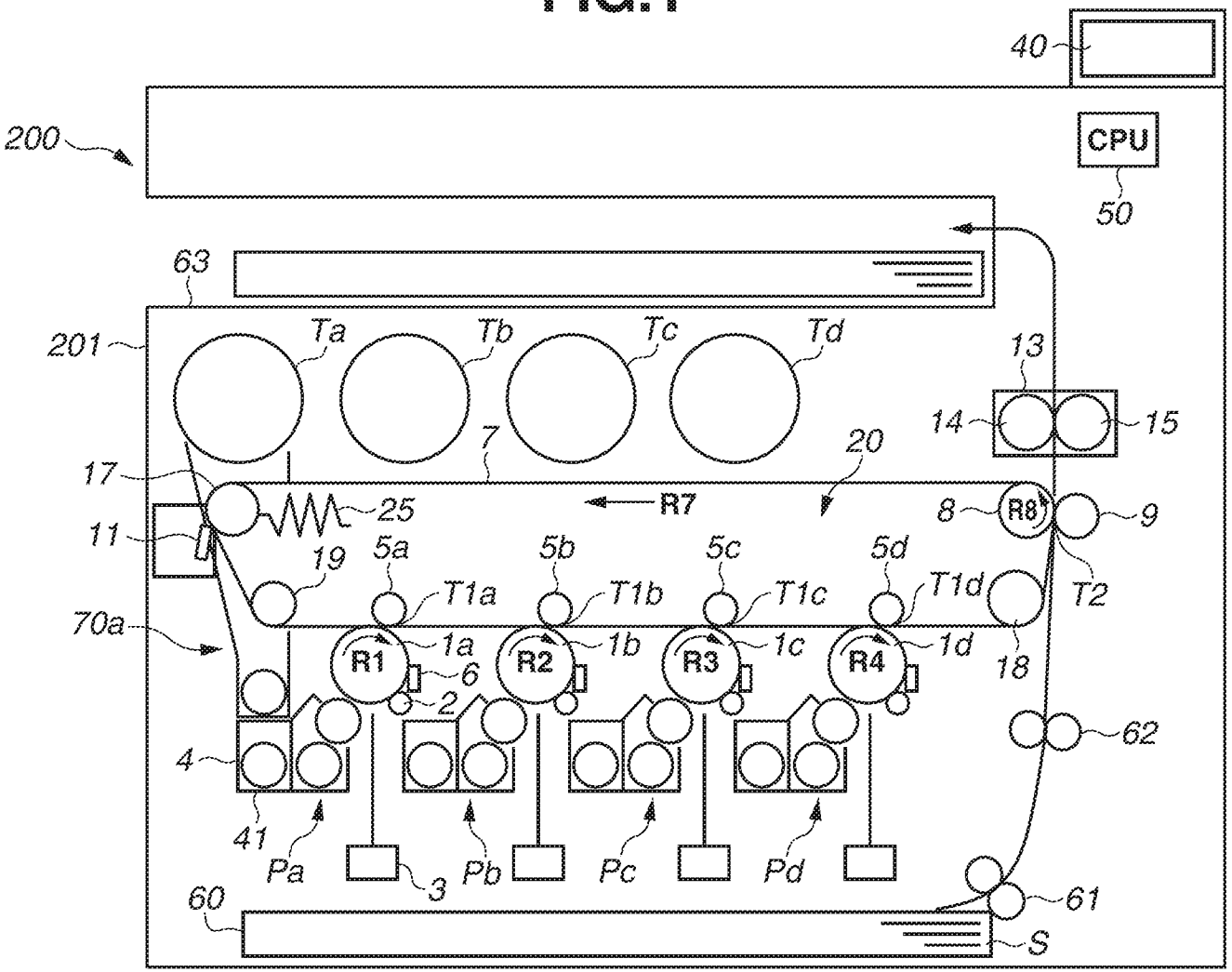
FIG. 1 is a schematic diagram illustrating a configuration of an image forming apparatus according to the present disclosure.

As illustrated in FIG. 1, an image forming apparatus 200 according to a first exemplary embodiment is a so-called intermediate transfer tandem printer including four image forming units Pa, Pb, Pc, and Pd and an intermediate transfer unit 20 within an apparatus main body 201. Based on image information read from a document or image information input from an external device, the image forming apparatus 200 forms an image on a recording material S and outputs the recording material S. Examples of the recording material S include plain paper, special paper such as coated paper, recording materials having special shapes, such as an envelope and index paper, overhead projector plastic film, and cloth.

The image forming units Pa, Pb, Pc, and Pd are image forming units for forming yellow, magenta, cyan, and black toner images and include respective photosensitive drums 1*a*, 1*b*, 1*c*, and 1*d*, as image bearing members for electrophotography. The configurations of the image forming units Pa, Pb, Pc, and Pd are basically similar to each other except for the color of toner for use in development, and therefore are described below using the configuration of the yellow image forming unit Pa as an example.

The image forming unit Pa includes a charging device 2, an exposure device 3, a developing device 4, and a drum cleaner 6 around the photosensitive drum 1*a*, which is a drum-like photosensitive member. If an image forming operation starts, the photosensitive drum 1*a* is driven to rotate, and the surface of the photosensitive drum 1*a* is uniformly charged by the charging device 2. Then, an electrostatic latent image is formed on the surface of the drum by the exposure device 3. Yellow toner is supplied to the photosensitive drum 1*a* from the developing device 4, which stores a developer within a developing container 41, thereby visualizing (developing) the electrostatic latent image formed on the photosensitive drum 1*a* into a toner image. In other words, the charging device 2, the exposure device 3, and the developing device 4 form a toner image forming unit for forming a toner image on the photosensitive drum 1*a* as one of the image bearing members.

To the apparatus main body 201, developer storage containers Ta, Tb, Tc, and Td are detachably attached, which store developers to be resupplied. For example, the developer storage container Ta stores a developer containing yellow toner, which is appropriately resupplied to the developing container 41 via a resupply device 70*a*. Further, as the developer, a two-component developer containing a magnetic carrier and a nonmagnetic toner, a monocomponent developer composed of a magnetic toner, or a liquid developer obtained by dispersing toner particles in a carrier liquid can be used.

The intermediate transfer unit 20 includes an intermediate transfer belt 7 as an endless belt member, and a plurality of roller members (8, 17, 18, and 19) around which the intermediate transfer belt 7 is stretched. Specifically, the intermediate transfer belt 7 is wound around a secondary transfer inner roller 8, a steering roller 17, a separation roller 19, and an upstream guide roller 18 and opposed to the photosensitive drums 1*a* to 1*d* of the image forming units Pa to Pd on its outer peripheral surface. Further, on the inner peripheral side of the intermediate transfer belt 7, primary transfer rollers 5*a*, 5*b*, 5*c*, and 5*d* are placed, which form primary transfer units. The primary transfer rollers 5*a* to 5*d* are placed at positions corresponding to the photosensitive drums 1*a* to 1*d* of the image forming units Pa to Pd, thereby forming respective primary transfer units T1*a*, T1*b*, T1*c*, and T1*d*, which transfer toner images from the photosensitive drums 1*a* to 1*d*, onto the intermediate transfer belt 7.

The secondary transfer inner roller 8 is driven to rotate in a predetermined direction (an arrow R8) by a motor (not illustrated), whereby the intermediate transfer belt 7 rotates, in an arrow R7 direction, along with the rotation (arrows R1, R2, R3, and R4) of the photosensitive drums 1*a* to 1*d* of the respective image forming units Pa to Pd. The secondary transfer inner roller 8 is opposed to a secondary transfer outer roller 9 through the intermediate transfer belt 7, and a secondary transfer unit T2 is formed as a nip portion between the secondary transfer inner roller 8 and the secondary transfer outer roller 9.

The upstream guide roller 18 is placed upstream of the secondary transfer inner roller 8 and downstream of the primary transfer rollers 5*a* to 5*d* in the rotational direction of the intermediate transfer belt 7 and guides the intermediate transfer belt 7 into the secondary transfer unit T2 from a certain direction. As will be described in detail below, the steering roller 17 has a center adjustment function for controlling the position in the width direction of the intermediate transfer belt 7. The separation roller 19 is placed downstream of the steering roller 17 and upstream of the primary transfer rollers 5*a* to 5*d* in the rotational direction of the intermediate transfer belt 7. The primary transfer rollers 5*a* to 5*d* and the separation roller 19 move by a separation mechanism, and thereby can change the stretched form of the intermediate transfer belt 7 and separate the outer peripheral surface of the intermediate transfer belt 7 from some or all of the photosensitive drums 1*a* to 1*d*.

Toner images formed on the photosensitive drums 1*a* to 1*d* at the image forming units Pa to Pd by an image forming operation similar to the above are primarily transferred onto the intermediate transfer belt 7 at the primary transfer units T1*a* to T1*d* by electrostatic biases applied to the primary transfer rollers 5*a* to 5*d*. At this time, in a case where a color image is formed, the toner images are subjected to multiple transfer such that the toner images borne on the photosensitive drums 1*a* to 1*d* are superimposed on each other. Attached objects such as transfer residual toner remaining on the photosensitive drums 1*a* to 1*d* after the intermediate transfer belt 7 passes through the primary transfer units T1*a* to T1*d* are removed by the drum cleaners 6.

The toner image borne on the intermediate transfer belt 7 is secondarily transferred onto the recording material S at the secondary transfer unit T2 by applying an electrostatic bias to the secondary transfer outer roller 9. Attached objects such as transfer residual toner remaining on the intermediate transfer belt 7 after the intermediate transfer belt 7 passes through the secondary transfer unit T2 are removed by a belt cleaning device 11.

In parallel with such an image forming operation, the recording material S set in a feed cassette 60 is fed to a registration roller pair 62 by a feed unit 61 such as feed rollers. The registration roller pair 62 corrects the skew of the recording material S and also sends the recording material S into the secondary transfer unit T2 in time with the progress of the image forming operation by the image forming units Pa, Pb, Pc, and Pd.

The recording material S onto which an unfixed toner image has been transferred at the secondary transfer unit T2 is delivered to a fixing device 13. The fixing device 13 includes a heating roller 14, which is heated by a heat source such as a halogen heater, and an opposing roller 15, which comes into pressure contact with the heating roller 14. The fixing device 13 nips and conveys the recording material S while applying heat and pressure to the toner image. Consequently, the toner particles are fused and firmly fixed, thereby fixing the image to the recording material S. After passing through the fixing device 13, the recording material S is discharged to a discharge tray 63, which is provided above the apparatus main body 201. Further, in a case where two-sided printing is performed, the recording material S is conveyed again to the registration roller pair 62 in the state where a first surface (a front surface) and a second surface (a back surface) of the recording material S are reversed via a reverse conveying path (not illustrated). Then, after passing through the secondary transfer unit T2 and the fixing device 13, the recording material S is discharged to the discharge tray 63 in the state where an image is formed on the back surface of the recording material S.

On the upper surface of the apparatus main body 201, an operation display unit 40 as a user interface is provided. The operation display unit 40 includes a liquid crystal panel capable of displaying the current setting information, and various buttons for allowing a user to input information. Thus, it is possible to make a setting for, for example, switching an output image between a color image and a monochrome image. Further, in the apparatus main body 201, a central processing unit (CPU) 50 is provided, which performs overall control of the operation of the image forming apparatus 200 based on information input through the operation display unit 40.

[Intermediate Transfer Unit]

Figure 2A:
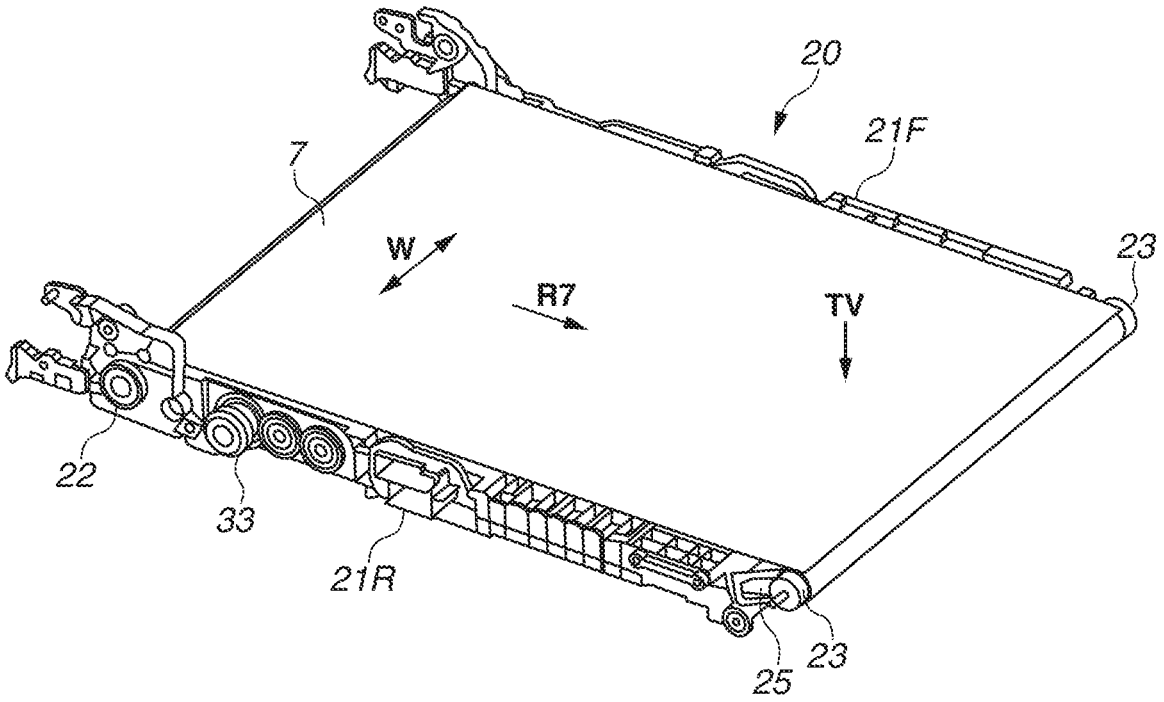
FIG. 2A is a perspective view of an intermediate transfer unit.
Figure 2B:
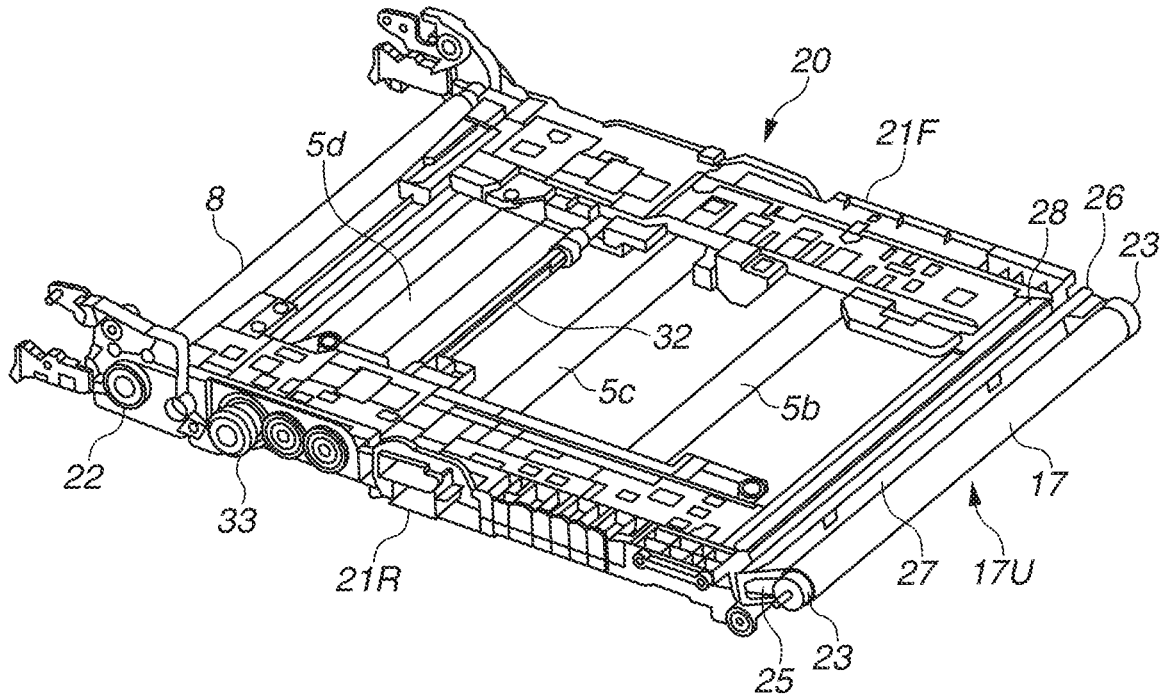
FIG. 2B is a perspective view of the intermediate transfer unit from which an intermediate transfer belt is detached.

Next, the internal configuration of the intermediate transfer unit 20, which is an example of the belt conveying device, and the configuration for steering the intermediate transfer belt 7 will be described. FIGS. 2A and 2B are perspective views of the intermediate transfer unit 20. FIG. 2A illustrates the state where the intermediate transfer belt 7 is stretched. FIG. 2B illustrates the state where the intermediate transfer belt 7 is detached.

As illustrated in FIGS. 2A and 2B, the intermediate transfer unit 20 includes a front frame 21F and a rear frame 21R, which are supported by the apparatus main body 201. The front frame 21F is a frame member on the front side (the near side in FIG. 1) of the intermediate transfer unit 20. The rear frame 21R is a frame member on the opposite side, i.e., the rear side, of the intermediate transfer unit 20. Both ends in the axial direction of each of the secondary transfer inner roller 8, the upstream guide roller 18, and the separation roller 19 are rotatably and axially supported in a sandwiched manner between the front frame 21F and the rear frame 21R. The axial directions of the rollers 8, 18, and 19 are defined as a width direction W of the intermediate transfer belt 7. Further, a belt automatic center adjustment mechanism 17U, which includes the steering roller 17, is supported by a frame supporting plate 28, which bridges the front frame 21F and the rear frame 21R.

To one end portion in the axial direction of the secondary transfer inner roller 8, a drive coupling 22 is attached. In the state where the intermediate transfer unit 20 is attached to the apparatus main body 201, the drive coupling 22 is linked to an output shaft of a belt driving unit (not illustrated) and transmits the driving force of the belt driving unit to the secondary transfer inner roller 8. The belt driving unit includes a driving source such as a motor, and a coupling member to be engaged with the drive coupling 22, and is provided in the apparatus main body 201. The surface of the secondary transfer inner roller 8 is formed of a material having a relatively high coefficient of friction, such as rubber, so that the driving force is transmitted to the secondary transfer inner roller 8, whereby the surface of the roller conveys and drives the intermediate transfer belt 7 in the direction of the arrow R7 in FIG. 2A. In the present exemplary embodiment, the drive coupling 22 is used as a drive transmission method. Alternatively, for example, a driving source of the apparatus main body 201 and the intermediate transfer unit 20 may be linked together using gears capable of coming into contact with and separating from each other.

Figure 3:
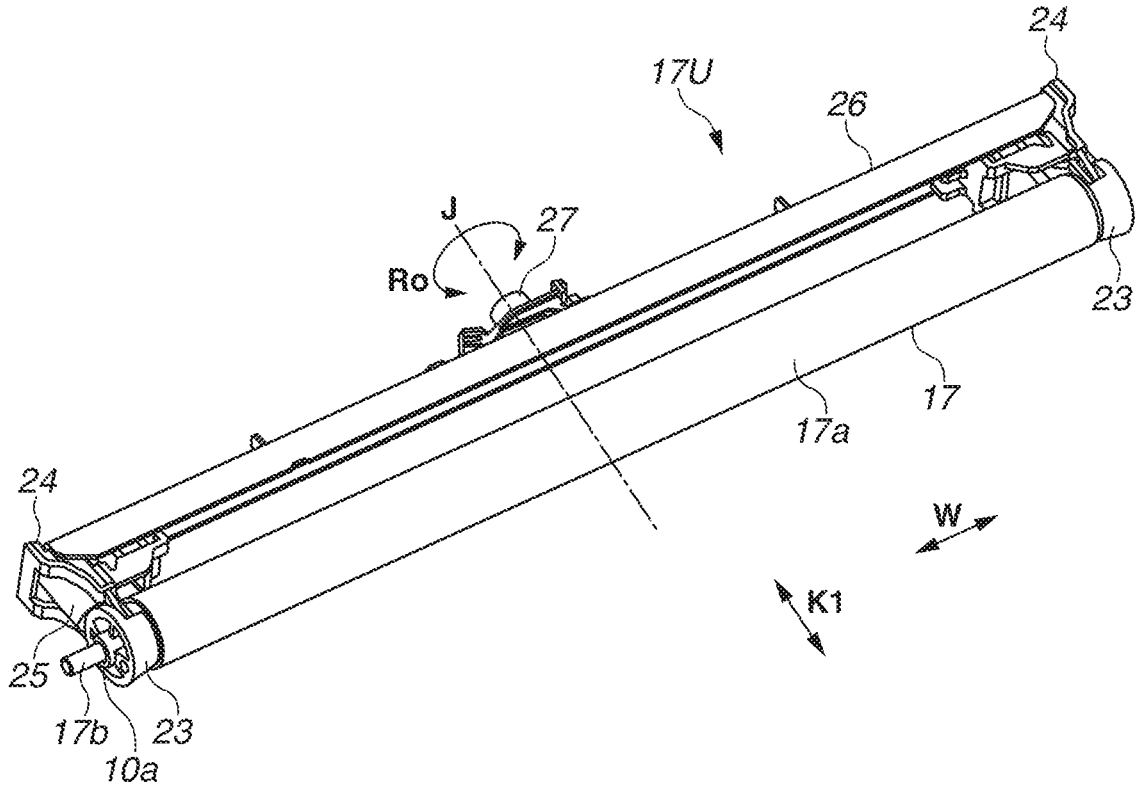
FIG. 3 is a perspective view of a belt automatic center adjustment mechanism.
Figure 4:
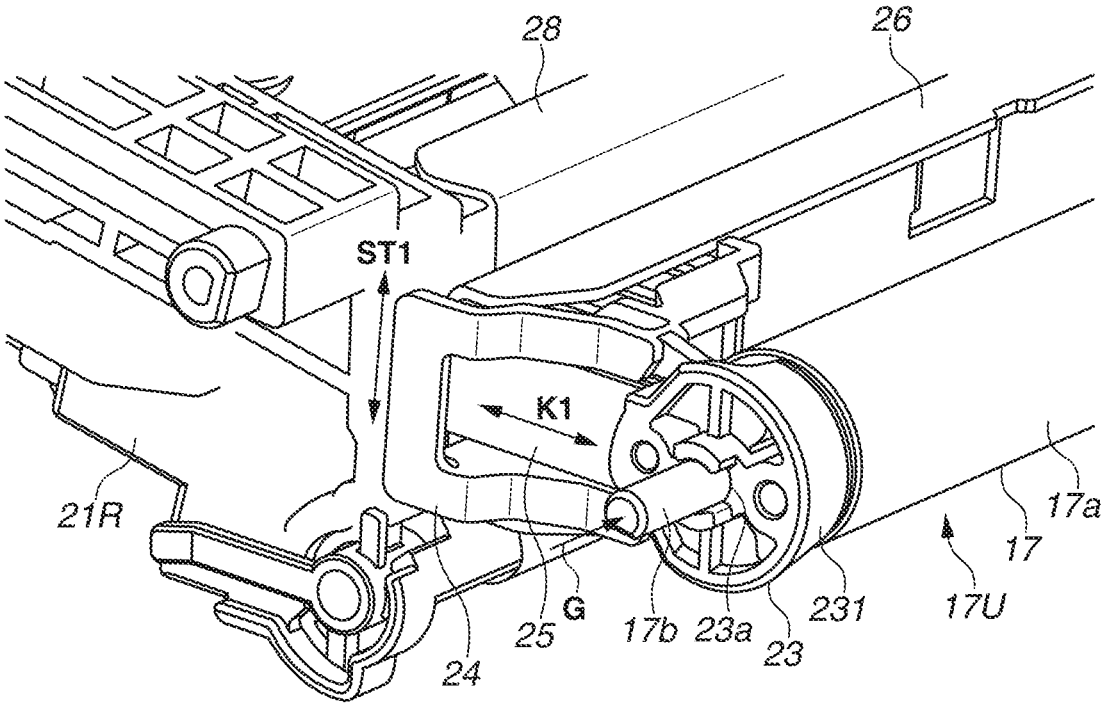
FIG. 4 is an enlarged view of an end portion of the belt automatic center adjustment mechanism.

In the present exemplary embodiment, for the intermediate transfer belt 7 that is driven and conveyed as described above, the following belt automatic center adjustment mechanism is included. The belt automatic center adjustment mechanism can make a belt center adjustment of (steer) the intermediate transfer belt 7, i.e., control the position in the width direction W of the intermediate transfer belt 7, by the steering roller 17 maintaining the balance between the frictional forces of both end portions of the intermediate transfer belt 7. With reference to FIGS. 3 and 4, the configuration of a belt automatic center adjustment mechanism 17U, which is an example of a steering mechanism will be described below. FIG. 3 is a perspective view illustrating the belt automatic center adjustment mechanism 17U. FIG. 4 is an enlarged view of an end portion of the belt automatic center adjustment mechanism 17U.

As illustrated in FIG. 3, the steering roller 17 includes a cylindrical roller main body 17*a* and roller shafts 17*b*, which protrude from the roller main body 17*a* on both sides in the axial direction of the steering roller 17. At positions opposed to both end portions in the axial direction of the steering roller 17, respective steering bearings 23 and 23 are placed. Each roller shaft 17*b* is rotatably and axially supported by the steering bearing 23 in the state where the roller shaft 17*b* is inserted in a fitting manner through a supporting hole 10*a*, which is provided in the steering bearing 23.

The pair of steering bearings 23 is attached to a swinging plate 26 in the state where the steering bearings 23 support both end portions in the axial direction of the steering roller 17, which is one of a plurality of stretching rollers around which the intermediate transfer belt 7 is stretched. The steering bearings 23 are slidably supported by slide guides 24, which are attached to both end portions of the swinging plate 26. Between the steering bearings 23 and the slide guides 24, tension springs 25, which are compression springs, are provided in contracted states.

The swinging plate 26 is an example of a member for swinging the steering roller 17, thereby supporting the steering roller 17 in the state where the relative alignment of the steering roller 17 with the secondary transfer inner roller 8 can be changed. Further, the tension springs 25 are examples of biasing members for applying tension to act on the inner periphery of the intermediate transfer belt 7 to the steering roller 17. That is, the tension springs 25 as the biasing members according to the present exemplary embodiment are composed of a pair of spring members for applying biasing forces to the pair of steering bearings 23 at both end portions of the swinging plate 26.

As illustrated in FIGS. 3 and 4, the slide guides 24 include fitting grooves for guiding the steering bearings 23 to move along the pressurization directions of the tension springs 25 (the direction of an arrow K1). That is, the slide guides 24 form portions for guiding the pair of steering bearings 23 in the biasing directions of the tension springs 25. Further, the slide guides 24 include stoppers (not illustrated) capable of restricting the movement of the steering bearings 23 in the pressurization directions of the tension springs 25. The stoppers prevent the steering bearings 23 and the steering roller 17 from coming off in an assembly state where the belt automatic center adjustment mechanism 17U is not attached to the intermediate transfer unit 20. With these components, it is possible to effectively transmit the biasing forces of the tension springs 25 in both end portions to the respective steering bearings 23.

In the state where the intermediate transfer belt 7 is stretched around the steering roller 17 and the other roller members (8, 18, and 19) as illustrated in FIG. 2A, the steering bearings 23 move in the direction in which the steering bearings 23 compress the tension springs 25 more than at the positions where the movement of the steering bearings 23 are restricted by the stoppers. Thus, in this state, the steering roller 17 is pressed against the inner peripheral surface of the intermediate transfer belt 7 by the elastic forces of the tension springs 25, and tension occurs in the intermediate transfer belt 7. That is, the steering roller 17 according to the present exemplary embodiment doubles as a tension roller for applying appropriate tension to the intermediate transfer belt 7 by biasing forces from the biasing members.

As illustrated in FIG. 3, in the swinging plate 26 as the swinging member, a pivotal shaft member 27 as a supporting shaft is fixed to a center portion in the width direction W of the swinging plate 26 in the state where the pivotal shaft member 27 protrudes backwards in FIG. 3, and the slide guides 24 and 24 are also fixed to both end portions of the swinging plate 26. The pivotal shaft member 27 is fit in a pivotable state to a fitting portion (not illustrated) provided in the frame supporting plate 28, thereby rotatably (swingably) supporting the swinging plate 26.

Consequently, the swinging plate 26 can swing in a swinging direction Ro about a steering axis J, which is the axis of the pivotal shaft member 27, in the state where the swinging plate 26 supports the steering roller 17. That is, the belt automatic center adjustment mechanism 17U, which is an example of an alignment change unit for changing the alignment of the belt member, is configured as a unit capable of swinging together with the steering roller 17 relative to the frame members of the intermediate transfer unit 20.

[Operating Principle of Belt Automatic Center Adjustment Mechanism]

Figure 5A:
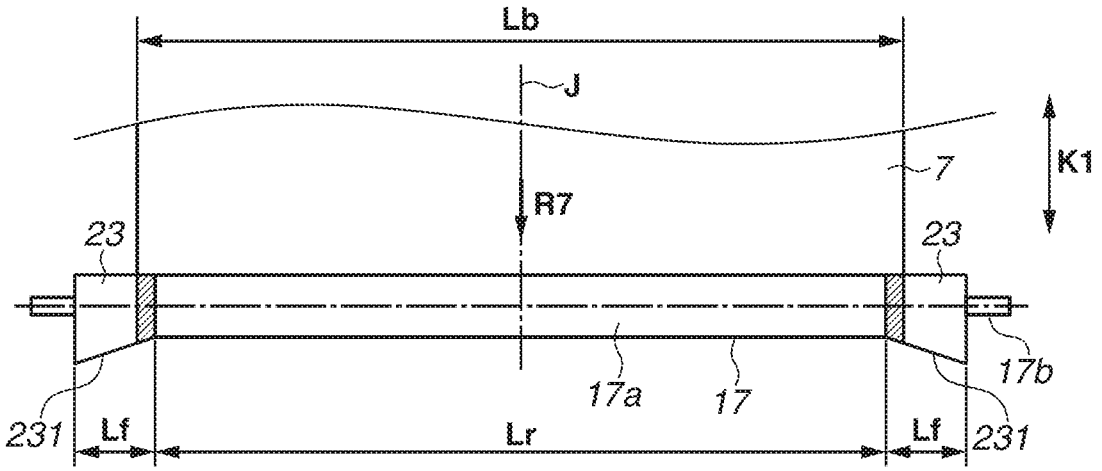
FIG. 5A is a schematic diagram illustrating an operating principle of the belt automatic center adjustment mechanism and illustrates a steady state.
Figure 5B:
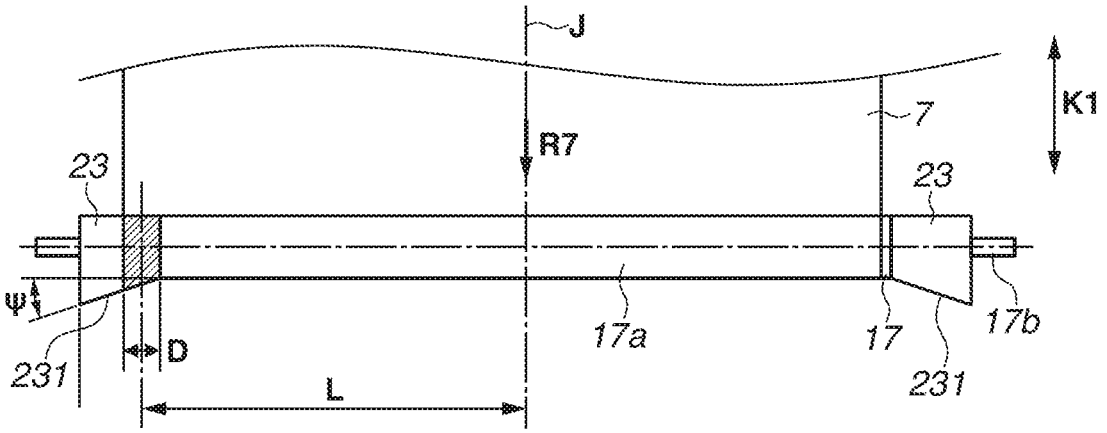
FIG. 5B is a schematic diagram illustrating the operating principle of the belt automatic center adjustment mechanism and illustrates a state where a deviation occurs in the belt.

Next, with reference to FIGS. 4, 5A, and 5B, the detailed configuration and the operation of the belt automatic center adjustment mechanism according to the present exemplary embodiment are described. Each of FIGS. 5A and 5B is a plan view (a top view) from a viewpoint in the direction of an arrow TV in FIG. 2A. FIG. 5A illustrates a steady state where forces in the width direction W acting on the intermediate transfer belt 7 by the operation of the belt automatic center adjustment mechanism 17U are balanced, i.e., the state where the winding position of the intermediate transfer belt 7 is a nominal position. FIG. 5B illustrates the state where a belt deviation occurs on the left side in FIG. 5B while the intermediate transfer belt 7 is conveyed in the direction of the arrow R7.

As illustrated in FIG. 4, each steering bearing 23, which axially supports the roller shaft 17*b*, includes a sliding friction surface 231, which comes into sliding contact with the inner peripheral surface of the intermediate transfer belt 7, thereby generating steering torque. The "steering torque" refers to the moment of a force to change the alignment of the steering roller 17 in the direction in which the deviation of the intermediate transfer belt 7 can be reduced. As described above, the moving direction of the steering bearing 23 is restricted by the slide guide 24 so that the steering bearing 23 moves in the direction of the arrow K1. Thus, the steering bearing 23, which is an example of a friction portion, is not driven with the conveyance and driving of the intermediate transfer belt 7 in the direction of the arrow R7, but comes into sliding contact with the inner peripheral surface of the belt.

The sliding friction surface 231 is formed into a tapered shape such that the further outside in the axial direction of the steering roller 17, the larger the outer diameter of the sliding friction surface 231 gradually becomes. The maximum diameter of the sliding friction surface 231 is larger than the outer diameter of the steering roller 17, which is cylindrical. As illustrated in FIG. 5B, in the present exemplary embodiment, the outer diameter of the steering roller 17 is set to φ16 (16 mm), for example. The sliding friction surface 231 of the steering bearing 23 includes an outer peripheral portion having a circumference corresponding to φ16 in a joint portion with the steering roller 17. The sliding friction surface 231 has a curved surface shape such that the diameter of the sliding friction surface 231 gradually becomes larger outward at the rate of a taper angle $\psi=10°$ from the outer peripheral portion.

Further, in the present exemplary embodiment, the dimension in the width direction W, i.e., a direction orthogonal to the conveyance driving direction (the direction of the arrow R7), of the intermediate transfer belt 7 is set to partially cover the region of the sliding friction surface 231 having the taper angle ψ. In other words, a width Lb of the intermediate transfer belt 7 is set to be longer than the length (Lr) in the axial direction of the roller main body 17*a* of the steering roller 17 and shorter than the width (Lr+2Lf) between both ends of the steering bearings 23 and 23 ($Lr<Lb<Lr+2Lf$). Lf is the length in the width direction W of the sliding friction surface 231 of each steering bearing 23.

With reference to FIGS. 5A and 5B, the operating principle that the intermediate transfer belt 7 comes into sliding friction with the steering bearings 23, thereby enabling a belt automatic center adjustment will be described. As described above, the steering bearings 23 are supported so that the steering bearings 23 cannot be driven with the intermediate transfer belt 7. Thus, while the intermediate transfer belt 7 is conveyed and driven, the steering bearings 23 can come into sliding contact with the inner peripheral surface of the belt. At this time, frictional forces occur in regions where the intermediate transfer belt 7 is wound around the steering bearings 23, i.e., regions on the right side where the intermediate transfer belt 7 moves downward as viewed from the direction of an arrow G in FIG. 4. Thus, downward frictional forces act on the steering bearings 23.

As described above, the dimension (Lb) in the width direction W of the intermediate transfer belt 7 is set to cover the tapered sliding friction surfaces 231 and 231 of the steering bearings 23 and 23. Thus, in the steady state (the nominal state) illustrated in FIG. 5A, the intermediate transfer belt 7 comes into sliding friction with the sliding friction surfaces 231 of both the steering bearings 23 and 23 at equivalent winding widths (e.g., 2 mm). In this state, moments generated by frictional forces acting on the steering bearings 23 and 23 on both sides from the intermediate transfer belt 7 cancel out each other.

That is, the frictional forces received by the steering bearings 23 and 23 from the intermediate transfer belt 7 act on the steering bearings 23 and 23 and the swinging plate 26 as moments in opposite directions to each other with respect to the steering axis J. Thus, in the steady state illustrated in FIG. 5A, the frictional forces received by the steering bearings 23 and 23 are approximately equal to each other, and the moments cancel out each other, thereby maintaining the orientation of the swinging plate 26. Consequently, the steering roller 17 is held in the orientation in which the axial direction of the steering roller 17 is approximately parallel to those of the other roller members such as the secondary transfer inner roller 8 (the state where the axial directions are aligned with each other).

In contrast, as illustrated in FIG. 5B, in the state where a so-called "deviation" occurs, in which the intermediate transfer belt 7 deviates to either one side in the width direction W, the winding width of the intermediate transfer belt 7 on one of the steering bearings 23 is greater than the winding width of the intermediate transfer belt 7 on the other steering bearing 23. In the example illustrated in FIG. 5B, the winding width of the intermediate transfer belt 7 on the steering bearing 23 on the left side in FIG. 5B is D [mm], and the winding width of the intermediate transfer belt 7 on the steering bearing 23 on the right side in FIG. 5B is 0. That is, the intermediate transfer belt 7 is off the sliding friction surface 231 on the right side in FIG. 5B.

In this case, if a vertically downward frictional force received in the range of a certain winding width of the intermediate transfer belt 7 on each sliding friction surface 231 from the intermediate transfer belt 7 is F(ST), the magnitude of a force received by one of the steering bearings 23 is F(ST)*D. Meanwhile, the winding width of the intermediate transfer belt 7 on the other steering bearing 23 is 0. Thus, the other steering bearing 23 does not substantially receive a force from the intermediate transfer belt 7. Thus, in the state illustrated in FIG. 5B, steering torque to move a left end portion of the steering roller 17 downward (to the far side in FIG. 5B) is generated.

The steering angle of the steering roller 17 generated based on the above principle, i.e., the angle of inclination of the steering roller 17 in the state where the steering roller 17 is swung according to the steering torque, matches the direction in which the deviation of the intermediate transfer belt 7 is turned back to normal. Then, the deviation of the intermediate transfer belt 7 is reduced according to the conveyance of the belt. That is, the belt automatic center adjustment mechanism 17U converts part of a driving force to convey and drive the intermediate transfer belt 7 into steering torque, thereby exerting an automatic center adjustment effect of controlling the position in the width direction W of the intermediate transfer belt 7.

In the present exemplary embodiment, the configuration is such that the taper angle ψ is provided in each steering bearing 23, thereby setting a relatively low coefficient of friction μS and avoiding an abrupt steering operation. Specifically, a resin material having sliding friction properties (low-friction properties), such as polyacetal (POM), is used as the material of the steering bearing 23, the coefficient of friction μS is set to about 0.3, and the taper angle ψ is set to about 5 to 10°, whereby it is possible to obtain an excellent result. Further, in view of electrostatic adverse effects due to frictional charging with the intermediate transfer belt 7, the steering bearing 23 is also made conductive. The configuration may be such that the taper angle ψ and the sliding friction properties differ so long as required steering torque can be obtained. For example, the sliding friction surface 231 of the steering bearing 23 may be cylindrical.

[Separation Mechanism of Intermediate Transfer Belt]

Figure 6:
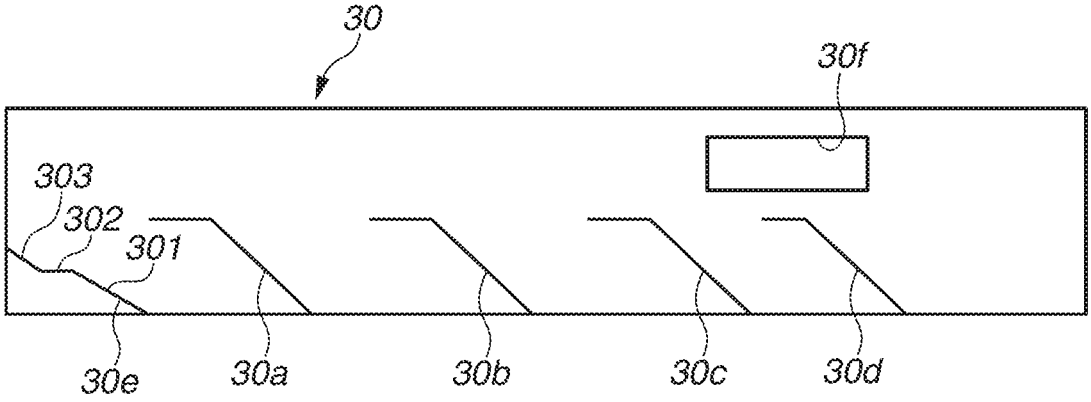
FIG. 6 is a schematic diagram of a separation slider according to a first exemplary embodiment.
Figure 7A:
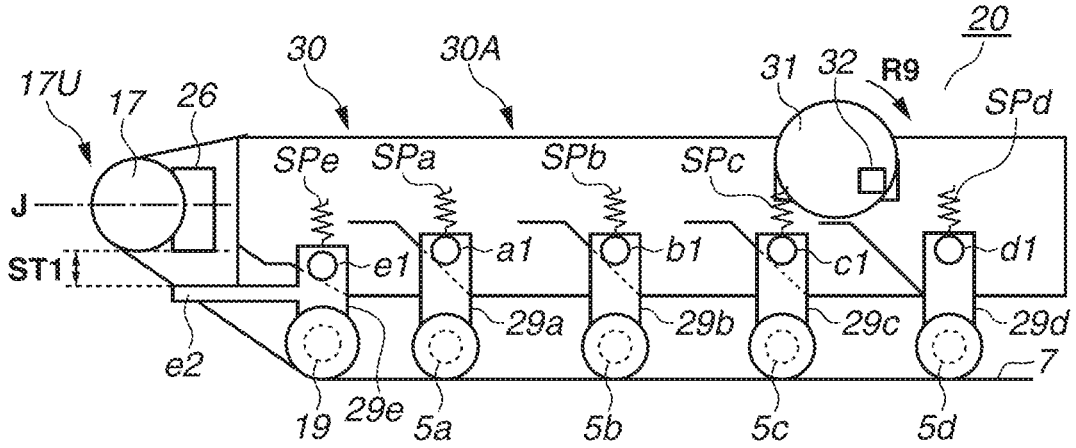
FIG. 7A is a schematic diagram illustrating an operation of a separation mechanism according to the first exemplary embodiment and illustrates a color mode.
Figure 7B:
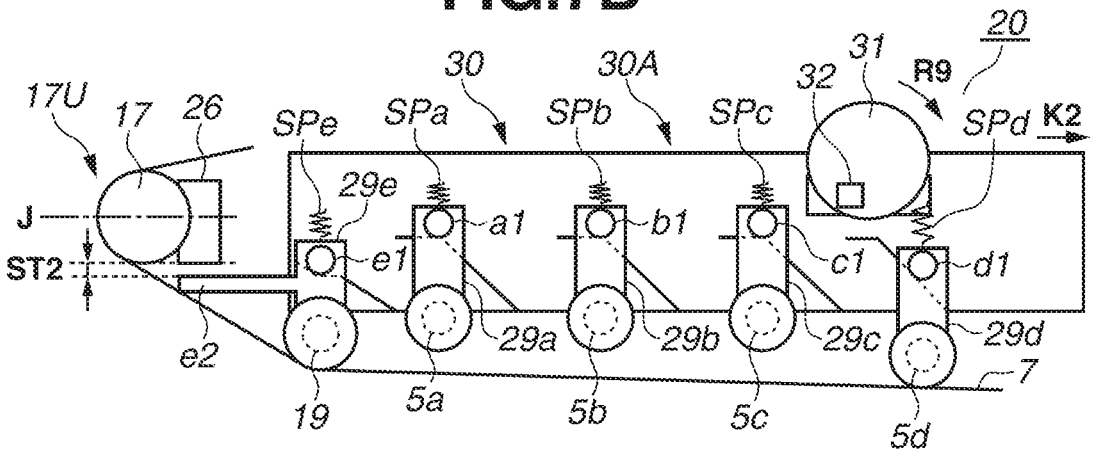
FIG. 7B is a schematic diagram illustrating the operation of the separation mechanism according to the first exemplary embodiment and illustrates a monochrome mode.
Figure 7C:
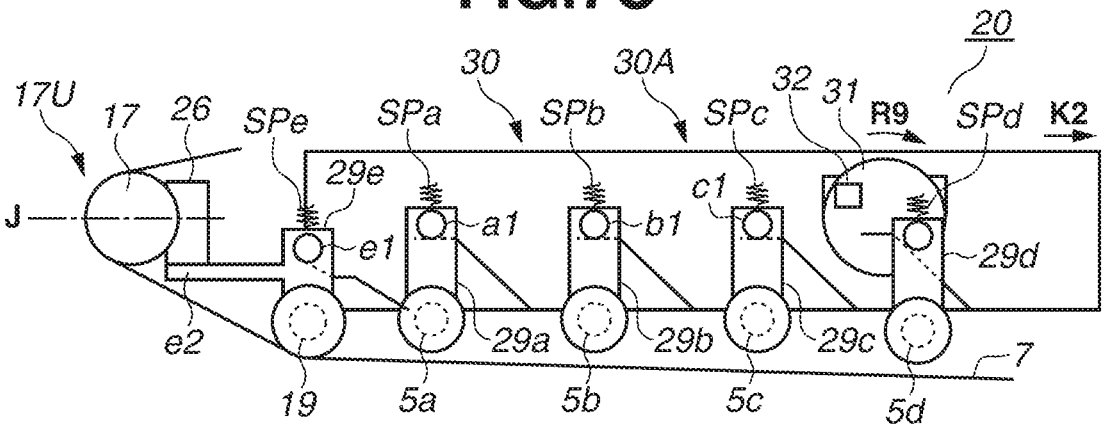
FIG. 7C is a schematic diagram illustrating the operation of the separation mechanism according to the first exemplary embodiment and illustrates an all-separation mode.

Next, with reference to FIGS. 6, 7A, 7B, and 7C, the configuration for enabling the separation of the intermediate transfer belt 7 from the photosensitive drums 1*a* to 1*d* will be described. FIG. 6 illustrates the state where a separation slider 30 is viewed from the front side. FIG. 7A schematically illustrates the intermediate transfer unit 20 in a color mode (hereinafter, a "CL mode"). FIG. 7B schematically illustrates the intermediate transfer unit 20 in a monochrome mode (hereinafter, a "BK mode"). FIG. 7C schematically illustrates the intermediate transfer unit 20 in an all-separation mode.

As described above, on the inner peripheral side of the intermediate transfer belt 7, the respective primary transfer rollers 5*a* to 5*d* are placed, which are opposed to the photosensitive drums 1*a* to 1*d* of the image forming units Pa to Pd (see FIG. 1). In the present exemplary embodiment, the primary transfer rollers 5*a* to 5*d* and the separation roller 19, which is located upstream of the primary transfer rollers 5*a* to 5*d*, are movable relative to the frame members of the intermediate transfer unit 20.

The primary transfer rollers 5*a* to 5*d* and the separation roller 19 are moved by an operation for sliding the separation slider 30 illustrated in FIG. 6. Separation sliders 30 are accommodated within the front frame 21F and the rear frame 21R of the intermediate transfer unit 20 (see FIG. 2) and have similar shapes. That is, each separation slider 30 includes four cam surfaces 30*a*, 30*b*, 30*c*, and 30*d*, which correspond to the respective primary transfer rollers 5*a* to 5*d*, and a cam surface 30*e*, which corresponds to the separation roller 19. The two separation sliders 30 slide in synchronization with each other relative to the front frame 21F and the rear frame 21R such that the moving directions of the separation sliders 30 are the left-right direction in FIG. 6.

Each of the cam surfaces 30*a* to 30*e* includes a sloping surface inclined with respect to the sliding directions of the separation sliders 30 and is formed to achieve the operations of the rollers (5*a* to 5*d* and 19) in the following mode switching. For example, the cam surface 30*e*, which corresponds to the separation roller 19, includes a flat portion 302, which corresponds to a middle position of the separation roller 19, and respective sloping surfaces 301 and 303, which extend to both sides from the flat portion 302 in the sliding direction and correspond to a lower position and an upper position of the separation roller 19.

As illustrated in FIGS. 7A to 7C, both ends in the axial directions of the primary transfer rollers 5*a* to 5*d* are rotatably and axially supported by corresponding primary transfer bearings 29*a* to 29*d*. The primary transfer bearings 29*a* to 29*d* are placed on both sides in the axial directions of the primary transfer rollers 5*a* to 5*d* and supported by the front frame 21F and the rear frame 21R. All the primary transfer bearings 29*a* to 29*d* are held by the front frame 21F and the rear frame 21R in the state where the primary transfer bearings 29*a* to 29*d* are fit to be movable in the up-down direction in FIGS. 7A to 7C. The movement of the primary transfer bearings 29*a* to 29*d* in a direction along the conveying direction (the arrow R7) of the intermediate transfer belt 7 is restricted.

In the primary transfer bearings 29*a* to 29*d*, respective abutment portions a1 to d1 are provided, which abut the cam surfaces 30*a* to 30*d*, of the separation sliders 30. Further, between the primary transfer bearings 29*a* to 29*d* and the front frame 21F and the rear frame 21R, respective primary transfer springs SPa to SPd are provided, which bias the primary transfer bearings 29*a* to 29*d* downward in FIGS. 7A to 7C to press the primary transfer bearings 29*a* to 29*d* against the cam surfaces 30*a* to 30*d*. In a case where the separation sliders 30 move in a sliding manner, the primary transfer bearings 29*a* to 29*d* move in the up-down direction in FIGS. 7A to 7C in the state where the respective abutment portions al to dl abut the cam surfaces 30*a* to 30*d*, whereby the primary transfer rollers 5*a* to 5*d* move.

Also for the separation roller 19, a movement configuration similar to those for the primary transfer rollers 5*a* to 5*d* is provided. That is, both ends in the axial direction of the separation roller 19 are rotatably and axially supported by separation roller bearings 29*e*, which are placed on both sides in the axial direction of the separation roller 19. The separation roller bearings 29*e* are held by the front frame 21F and the rear frame 21R in the state where the separation roller bearings 29*e* are movable in the up-down direction in FIGS. 7A to 7C, and the movement of the separation roller bearings 29*e* in a direction along the conveying direction (the arrow R7) of the intermediate transfer belt 7 is restricted. Further, the separation roller bearings 29*e* include abutment portions e1, which abut the cam surfaces 30*e* of the separation sliders 30. The separation roller bearings 29*e* are pressed against the cam surfaces 30*e* by separation roller springs SPe. In a case where the separation sliders 30 move in a sliding manner, the separation roller bearings 29*e* move in the up-down direction in FIGS. 7A to 7C in the state where the abutment portions e1 abut the cam surfaces 30*e*, whereby the separation roller 19 moves.

Each separation slider 30 includes a slide biasing surface 30*f* (see FIG. 6), which is engaged with a separation cam 31, which is attached to a separation cam shaft 32. The separation slider 30 is biased in the left-right direction in FIGS. 7A to 7C by the separation cam 31 pressing the slide biasing surface 30*f*. To an end portion in the axial direction of the separation cam shaft 32, a separation coupling 33 (see FIG. 2) is attached, which is linked to and driven by a driving source provided in the apparatus main body 201 of the image forming apparatus 200 in the state where the intermediate transfer unit 20 is attached to the apparatus main body 201. That is, the separation coupling 33 receives drive from the driving source, transmits the drive to the separation cam 31, and drives the separation slider 30.

The separation sliders 30 correspond to members movable in directions intersecting the moving directions (the up-down direction in FIGS. 7A to 7C) of the separation roller bearings 29*e*, which correspond to bearing members according to the present exemplary embodiment. Further, the separation roller springs SPe correspond to biasing units for biasing the bearing members toward cam surfaces, thereby causing the bearing members to follow the cam surfaces.

In the present exemplary embodiment, as described above, the primary transfer rollers 5*a* to 5*d* and the separation roller 19 are moved by a separation mechanism 30A, which includes the separation sliders 30 and the separation cams 31, thereby switching the modes illustrated in FIGS. 7A to 7C. The following mode switching is achieved by controlling the rotation phase of the separation cam shaft 32 based on a control signal from the CPU 50 (FIG. 1), which is provided in the image forming apparatus 200. Further, although a description is given using as an example an operation in a case where the modes are switched in the order of the CL mode, the BK mode, and the all-separation mode, the modes can be switched between any modes by tracing the operation backwards.

In the CL mode illustrated in FIG. 7A, all the primary transfer rollers 5*a* to 5*d* and the separation roller 19 are held at lower positions, and the intermediate transfer belt 7 abuts the respective photosensitive drums 1*a* to 1*d* of the image forming units Pa to Pd (see FIG. 1). In this state, the image forming units Pa to Pd execute an image forming operation, and toner images formed on the photosensitive drums 1*a* to 1*d* are transferred onto the recording material S via the intermediate transfer belt 7, whereby it is possible to form a full-color image on the recording material S. The separation roller 19 is placed upstream of the primary transfer roller 5*a* in the moving direction of the intermediate transfer belt 7 and adjacent to the primary transfer roller 5*a*. The separation roller 19 forms a stretched surface (a transfer surface) of the belt at the primary transfer unit T1*a*. In this manner, the separation roller 19 stretches the belt so that stretched surfaces (primary transfer surfaces) of the belt formed by the image forming units Pa to Pd are equal to each other. Further, even if the stretched surfaces of the belt change according to the swing of the steering roller 17, the separation roller 19 prevents the stretched surface of the belt at the primary transfer unit T1*a* from fluctuating.

In a case where the CL mode is switched to the BK mode illustrated in FIG. 7B, the separation cams 31 rotate 90 degrees in the direction of an arrow R9, and the separation sliders 30 slide rightward (an arrow K2) in FIG. 7B. In the BK mode, the cyan, magenta, and yellow primary transfer rollers 5*a*, 5*b*, and 5*c* move to upper positions and separate from the inner peripheral surface of the intermediate transfer belt 7, and the separation roller 19 also moves to the middle position. In this manner, the stretched state of the intermediate transfer belt 7 switches, and the photosensitive drums 1*a* to 1*c* and the intermediate transfer belt 7 separate from each other. This reduces the sliding friction between the photosensitive drums 1*a* to 1*c* and the intermediate transfer belt 7. At this time, the intermediate transfer belt 7 is stretched around the separation roller 19 at the middle position and the black primary transfer roller 5*d* remaining held at the lower position and separates from the photosensitive drums 1*a*, 1*b*, and 1*c* for the colors other than black. In this state, the black image forming unit Pd executes an image forming operation, and a toner image formed on the photosensitive drum 1*d* is transferred onto the recording material S via the intermediate transfer belt 7, whereby it is possible to form a monochrome image on the recording material S.

In a case where the BK mode is switched to the all-separation mode illustrated in FIG. 7C, the separation cams 31 further rotate 90 degrees in the direction of the arrow R9, and the separation sliders 30 slide rightward (the arrow K2) in FIG. 7C. In the all-separation mode, all the primary transfer rollers 5*a* to 5*d* move to upper positions and separate from the inner peripheral surface of the intermediate transfer belt 7, and the separation roller 19 also moves to the upper position. At this time, the intermediate transfer belt 7 is stretched around the separation roller 19 at the upper position and the upstream guide roller 18 (see FIG. 1) and separates from all the photosensitive drums 1*a* to 1*d*. In this manner, when the intermediate transfer unit 20 is attached to or detached from the apparatus main body 201, it is possible to prevent the intermediate transfer belt 7 from coming into contact with the photosensitive drums 1*a* to 1*d*. In a case where the work of replacing the intermediate transfer belt 7 is performed, and also in a case where, for example, the image forming apparatus 200 is waiting for a signal (a print job) giving an instruction to start an image forming operation, the intermediate transfer unit 20 is controlled to be in the all-separation mode.

The separation roller 19 is an example of a roller member around which the belt member is stretched. The lower position (FIG. 7A) corresponds to a first position, and the upper position (FIG. 7C) corresponds to a second position where the roller member is moved further inward on the inner peripheral side of the belt member than the first position. The separation mechanism 30A is an example of a mechanism for moving such a roller member to the first and second positions. The CL mode corresponds to a first state where the belt member abuts the image bearing members. The all-separation mode corresponds to a second state where the belt member separates from the image bearing members. Further, the BK mode corresponds to a third state where in a configuration including a plurality of image bearing members, the belt member abuts some of the image bearing members and separates from the other image bearing members.

[Attachment and Detachment of Intermediate Transfer Unit and Limitation on Range of Motion of Steering Roller]

Next, the configuration for attaching and detaching the intermediate transfer unit 20 to and from the apparatus main body 201 when the intermediate transfer belt 7 is replaced, and a limitation on the range of motion of the steering roller 17 in the all-separation mode will be described.

Figure 8:
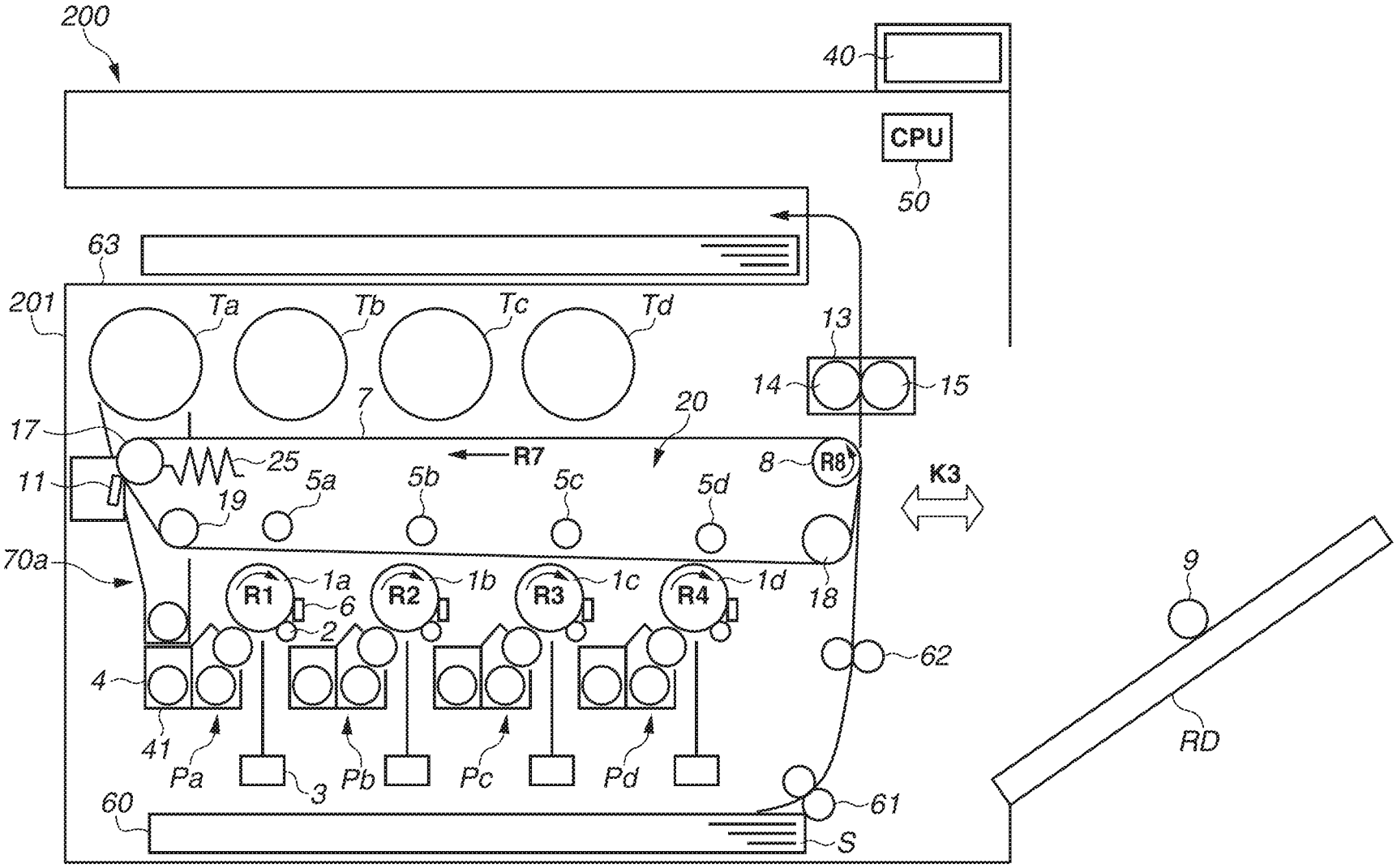
FIG. 8 is a schematic diagram illustrating a configuration for attaching and detaching the intermediate transfer unit to and from an apparatus main body.

As illustrated in FIG. 8, the intermediate transfer unit 20 is attachable to and detachable from the apparatus main body 201 of the image forming apparatus 200 in the state where the intermediate transfer unit 20 is held in the all-separation mode. Specifically, the intermediate transfer unit 20 is exposed by opening a right door RD, which is provided on the right side as viewed from the front of the apparatus main body 201. Then, the intermediate transfer unit 20 can be attached to or detached from the apparatus main body 201 by moving the intermediate transfer unit 20 in the left-right direction (an arrow K3).

Figure 9:
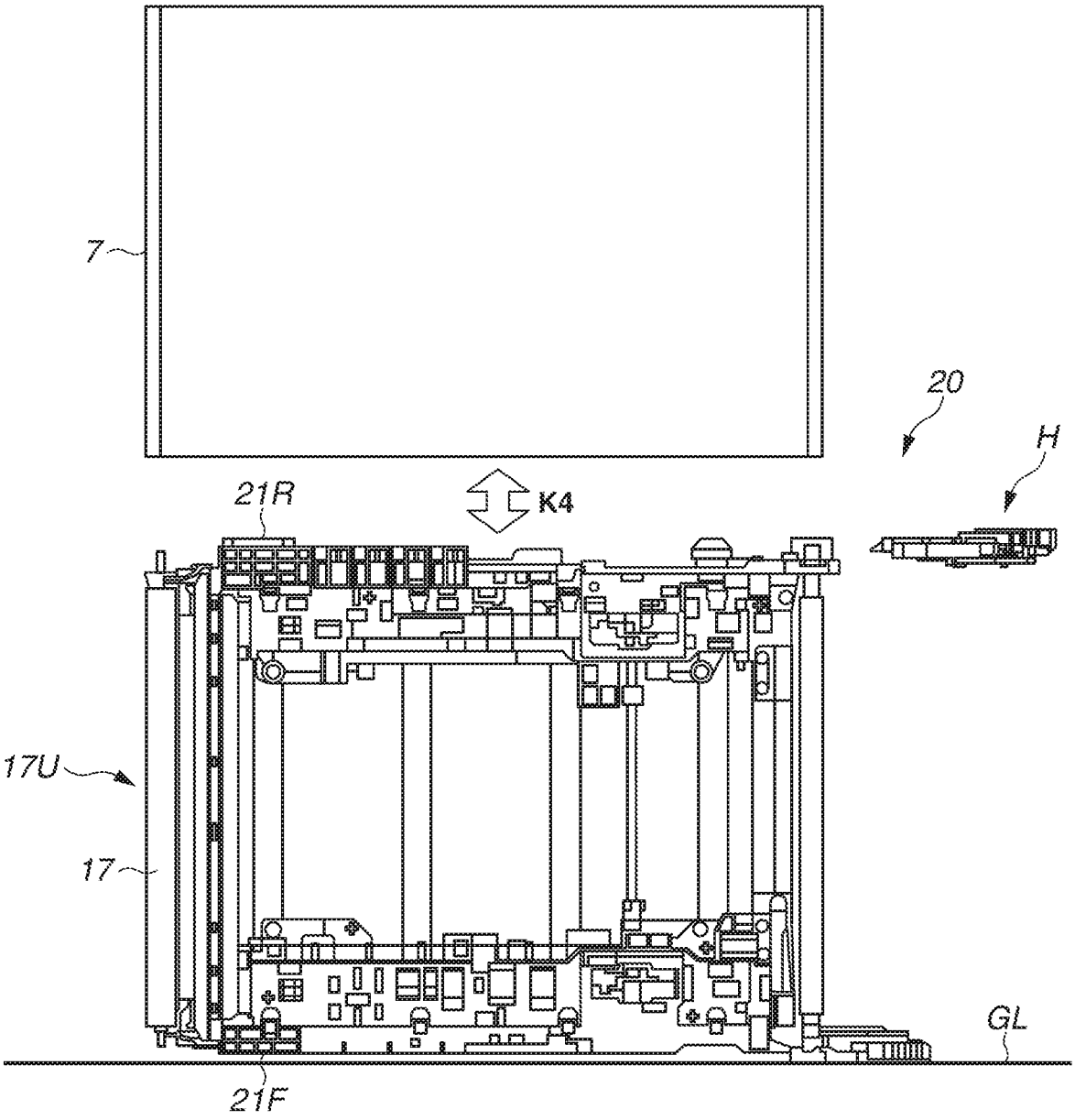
FIG. 9 is a schematic diagram illustrating work of replacing the intermediate transfer belt.

In a case where the work of replacing the intermediate transfer belt 7 is performed, it is desirable that as illustrated in FIG. 9, the intermediate transfer unit 20 should be placed such that the front frame 21F contacts a worktable GL, and the rear frame 21R is located vertically above the front frame 21F. The configuration may be such that the intermediate transfer unit 20 stands alone. Then, a person performing replacement work may replace the intermediate transfer belt 7 with one hand while holding the front frame 21F or the rear frame 21R. After the intermediate transfer unit 20 is stood upright, a holding portion H for an attachment/detachment operation is detached from the rear frame 21R, whereby the intermediate transfer belt 7 can be detached and attached again by moving the intermediate transfer belt 7 in the up-down direction (the width direction W of the belt, an arrow K4).

At this time, in a case where the steering roller 17 is freely swingable in such replacement work, excessive tension may be applied to or a twist may occur in the intermediate transfer belt 7 by a change in the alignment of the steering roller 17, and the intermediate transfer belt 7 may become damaged. Further, due to the fact that the orientation of the steering roller 17 is unstable, the workability of detaching and attaching the intermediate transfer belt 7 decreases. Further, even if the replacement work is not performed, but if the steering roller 17 swings in a configuration in which the tension of the intermediate transfer belt 7 becomes lower in the all-separation mode than in the CL mode, the deformation of the intermediate transfer belt 7 may become large, and the intermediate transfer belt 7 may come into contact with a member around the intermediate transfer belt 7.

In response, in the present exemplary embodiment, as part of the separation mechanism 30A, restriction portions capable of restricting the swinging range of the steering roller 17 in the all-separation mode are provided. As illustrated in FIG. 7A, projection portions e2 as restriction portions are provided in the separation roller bearings 29*e*. Thus, the projection portions e2 move together with the separation roller 19 in the up-down direction in FIG. 7A, i.e., relative to the steering axis J, which is the swing axis of the steering roller 17. Further, the projection portions e2 are provided in the respective separation roller bearings 29*e*, which are placed on both sides in the axial direction of the separation roller 19. The projection portions e2 extend to the upstream side in the rotational direction of the intermediate transfer belt 7 with respect to the rotational axis of the separation roller 19, i.e., leftward in FIG. 7A. Then, front end portions of the respective projection portions e2 are opposed to the swinging plate 26 of the belt automatic center adjustment mechanism 17U in the up-down direction.

Hereinafter, a swinging range from the state where the steering roller 17 is parallel to the secondary transfer inner roller 8 to the state where the swinging plate 26 abuts the projection portions e2 of the separation roller bearings 29*e* is defined as the range of motion of the belt automatic center adjustment mechanism 17U. That is, the range of motion of the belt automatic center adjustment mechanism 17U represents the range of angle about the steering axis J and at which the steering roller 17 is swingable without coming into contact with the projection portions e2. In FIGS. 7A to 7C, respective ranges of motion ST1 and ST2 of the belt automatic center adjustment mechanism 17U in the CL mode and the BK mode, are represented by the distance between the swinging plate 26 and each projection portion e2 in the up-down direction in a case where the steering roller 17 is parallel to the secondary transfer inner roller 8.

In the present exemplary embodiment, in the CL mode (FIG. 7A), the separation roller 19 is held at the lower position as the first position, and the belt automatic center adjustment mechanism 17U has the range of motion ST1, which is relatively large. In this state, the steering roller 17 is appropriately inclined according to the position of the intermediate transfer belt 7, and thereby can reduce the deviation in the width direction W of the intermediate transfer belt 7. In the BK mode (FIG. 7B), the separation roller 19 moves to the middle position, and the projection portions e2 come close to the swinging plate 26, whereby the range of motion ST2 of the belt automatic center adjustment mechanism 17U is smaller than the range of motion ST1 (ST2<ST1). That is, the maximum possible value of the angle of inclination of the steering roller 17 is smaller in the BK mode than in the CL mode.

At this time, since the separation roller 19 is held at the middle position in the BK mode, the amount of winding the intermediate transfer belt 7 around the steering roller 17 increases as compared with the CL mode where the separation roller 19 is held at the lower position. This means that the amount of winding the intermediate transfer belt 7 around each steering bearing 23 also increases. This leads to an increase in the frictional force to be applied to the sliding friction surface 231 of the steering bearing 23 by the intermediate transfer belt 7. That is, in the BK mode, the swinging range of the steering roller 17 is limited, while the responsiveness of the steering roller 17 to the deviation of the intermediate transfer belt 7 is improved due to an increase in the amount of winding the intermediate transfer belt 7, thereby assisting the function of reducing the deviation.

Thus, also in the BK mode, the automatic center adjustment function of the belt automatic center adjustment mechanism 17U is sufficiently exerted, and the position in the width direction W of the intermediate transfer belt 7 is controlled with high accuracy. In the case of a configuration in which a mounting space for the intermediate transfer unit 20 is sufficiently ensured, specifically, in a case where there is a relatively large space in the swinging direction of the steering roller 17, the range of motion ST2 in the BK mode may be sufficiently ensured. In a case where the mounting space is restricted, it is desirable to set the ranges of motion ST1 and ST2 also taking into account the influence of an increase in the amount of winding the intermediate transfer belt 7.

In the all-separation mode (FIG. 7C), according to the fact that the separation roller 19 moves to the upper position as the second position, the projection portions e2 come closer to the swinging plate 26 and abut the lower surface of the swinging plate 26. The projection portions e2 abut the swinging plate 26 on both sides in the width direction W with respect to the steering axis J. Thus, in the all-separation mode, the swing of the steering roller 17 is restricted, and the range of motion is substantially 0.

That is, in the present exemplary embodiment, the swinging range of the steering roller 17 is more restricted by the projection portions e2, which are provided as part of the separation mechanism 30A, in a case where the separation roller 19 is at the upper position than in a case where the separation roller 19 is at the lower position. In other words, the swinging range of the steering roller 17 is more restricted by the operations of the projection portions e2 as the restriction portions in a case where the roller member is at the second position than in a case where the roller member is at the first position.

With this configuration, in the intermediate transfer unit 20 having a plurality of stretching forms in which the position of the separation roller 19 varies, it is possible to reduce a change in the alignment of a stretching roller with a simple configuration. Then, in a case where the separation roller 19 is moved to the second position (the upper position) where the separation roller 19 is retracted further inward on the inner peripheral side of the belt than the first position (the lower position), such as a case where the intermediate transfer belt 7 is replaced, it is possible to restrict the swing of the steering roller 17. As a result, it is possible to prevent the intermediate transfer belt 7 and the belt automatic center adjustment mechanism 17U from being damaged by inadvertent swings of the steering roller 17 and the swinging plate 26.

Further, in the present exemplary embodiment, with a simple configuration in which the projection portions e2 for operating in conjunction with the separation roller 19 are provided, the swinging range of the steering roller 17 is restricted in a case where the separation roller 19 is at the second position. Thus, with a versatile configuration, regardless of which of a configuration in which a steering roller swings by a force from a belt member as in the present exemplary embodiment and a configuration in which a steering roller is swung by an actuator is used, it is possible to restrict the swinging range of the steering roller.

Further, the intermediate transfer unit 20 according to the present exemplary embodiment is configured to be detachable from the apparatus main body 201 of the image forming apparatus 200 (see FIGS. 8 and 9). In such a configuration, the intermediate transfer unit 20 is separated from members present around the intermediate transfer unit 20 within the apparatus main body 201. Thus, the steering roller 17 may largely swing. On the other hand, according to the configuration of the present exemplary embodiment, the swinging range of the steering roller 17 is restricted in the state where the intermediate transfer unit 20 is detached from the apparatus main body 201. Thus, it is possible to restrict an inadvertent swing of the steering roller 17.

In the present exemplary embodiment, the configuration has been such that in the all-separation mode (FIG. 7C), the swinging plate 26 and the projection portions e2 of the separation roller bearings 29*e* come into contact with each other. Alternatively, appropriate clearance may be provided taking into account the creep deformation or the tolerance of a component. For example, the configuration may be such that in the all-separation mode, about 1 to 2 mm of clearance is set between the swinging plate 26 and each projection portion e2, and the steering roller 17 is allowed to swing in a range corresponding to the clearance. That is, the configuration may be such that if the range of motion of the belt automatic center adjustment mechanism 17U in the all-separation mode is ST3, the range of motion ST3 and the ranges of motion ST1 and ST2 in the CL mode and the BK mode have the relationships ST1>ST2>ST3.

As a work procedure for replacing the intermediate transfer belt 7, the following two cases are possible. First, the intermediate transfer belt 7 is detached after the steering roller 17 is detached. Second, the intermediate transfer belt 7 is detached by releasing the tension of the intermediate transfer belt 7 with the steering roller 17 remaining attached. According to the configuration of the present exemplary embodiment, in either case, it is possible to restrict an inadvertent swing of the steering roller 17 at least in the state where the steering roller 17 is attached. Thus, it is possible to reduce the possibility that the belt automatic center adjustment mechanism 17U becomes damaged. Further, the swinging range of the swinging plate 26 is restricted also after the steering roller 17 is detached. Thus, it is possible to reduce the possibility that the swinging plate 26 collides with another member.

Next, with reference to FIGS. 10, 11A, 11B, and 11C, the configuration of a second exemplary embodiment is described. The present exemplary embodiment is different from the first exemplary embodiment in the moving range of the separation roller 19. The rest of the configuration is similar to that of the first exemplary embodiment. Thus, components similar to those of the first exemplary embodiment are designated by the same numerals, and are not described here.

Figure 10:
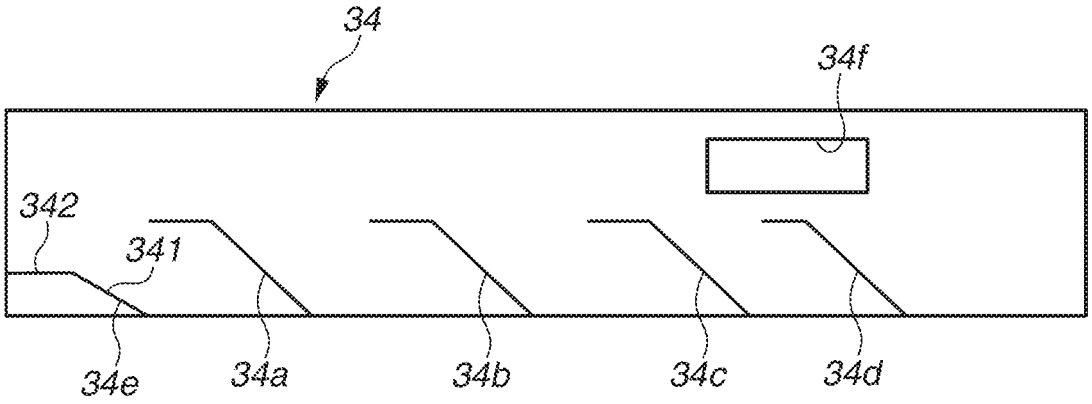
FIG. 10 is a schematic diagram of a separation slider according to a second exemplary embodiment.

Also in the present exemplary embodiment, the primary transfer rollers 5*a* to 5*d* and the separation roller 19 are moved by the movement of separation sliders accommodated within the front frame 21F and the rear frame 21R of the intermediate transfer unit 20. As illustrated in FIG. 10, each of separation sliders 34 includes four cam surfaces 34*a*, 34*b*, 34*c*, and 34*d*, which correspond to the respective primary transfer rollers 5*a* to 5*d*, and a cam surface 34*e*, which corresponds to the separation roller 19. Unlike the first exemplary embodiment, the cam surface 34*e*, which corresponds to the separation roller 19, includes a sloping surface 341, which corresponds to a lower position of the separation roller 19, and a flat portion 342, which corresponds to an upper position of the separation roller 19.

Figure 11A:
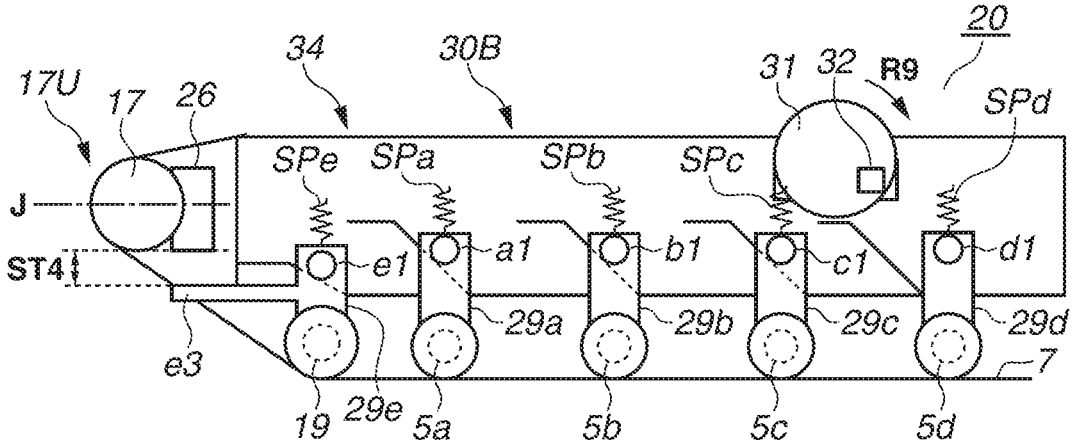
FIG. 11A is a schematic diagram illustrating an operation of a separation mechanism according to the second exemplary embodiment and illustrates a color mode.
Figure 11B:
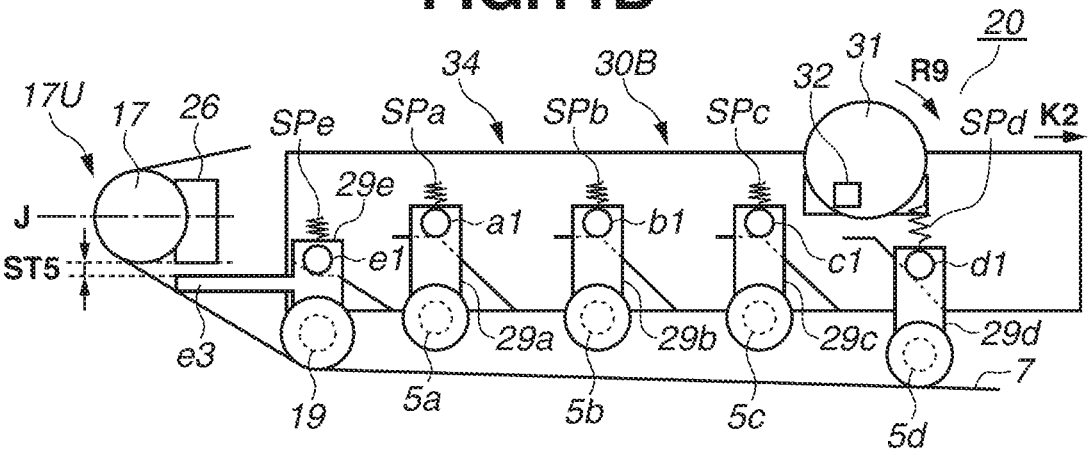
FIG. 11B is a schematic diagram illustrating the operation of the separation mechanism according to the second exemplary embodiment and illustrates a monochrome mode.
Figure 11C:
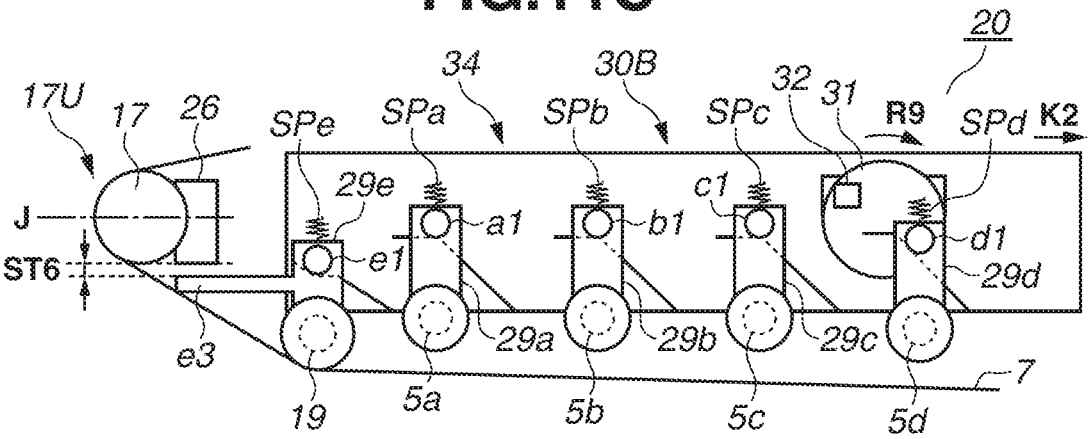
FIG. 11C is a schematic diagram illustrating the operation of the separation mechanism according to the second exemplary embodiment and illustrates an all-separation mode.

As illustrated in FIGS. 11A to 11C, a separation mechanism 30B, which is another example of the movement mechanism, includes the separation sliders 34, primary transfer bearings 29*a* to 29*d*, separation roller bearings 29*e*, separation cams 31, and a separation cam shaft 32, which rotates the separation cams 31. The separation cam shaft 32 drives the separation cams 31 to rotate in each predetermined phase, thereby pressing slider biasing surfaces 34*f* (see FIG. 10) of the separation sliders 34 to slide the separation sliders 34. Consequently, abutment portions al to e1 of the primary transfer bearings 29*a* to 29*d* and the separation roller bearings 29*e* move along the respective cam surfaces 34*a* to 34*e* of the separation sliders 34, and the primary transfer rollers 5*a* to 5*d* and the separation roller 19 move in the up-down direction in FIGS. 11A to 11C.

In the separation roller bearings 29*e*, projection portions e3, which are other examples of the restriction portions, are provided. The projection portions e3 move together with the separation roller 19 in the up-down direction in FIGS. 11A to 11C. The projection portions e3 are provided in the respective separation roller bearings 29*e*, which are placed on both sides in the axial direction of the separation roller 19. The projection portions e3 extend to the upstream side in the rotational direction of the intermediate transfer belt 7 with respect to the rotational axis of the separation roller 19, i.e., leftward in FIGS. 11A to 11C. Then, front end portions of the projection portions e3 are opposed to the swinging plate 26 of the belt automatic center adjustment mechanism 17U in the up-down direction.

FIG. 11A illustrates the intermediate transfer unit 20 in a CL mode. In this state, the intermediate transfer belt 7 abuts all the photosensitive drums 1*a* to 1*d* of the image forming units Pa to Pd, respectively (see FIG. 1). At this time, the separation roller 19 is held at the lower position, which corresponds to a first position, and a certain range of motion ST4 is ensured in the belt automatic center adjustment mechanism 17U.

FIG. 11B illustrates the intermediate transfer unit 20 in a BK mode. The cyan, magenta, and yellow primary transfer rollers 5*a*, 5*b*, and 5*c* move to upper positions higher than the positions of the primary transfer rollers 5*a*, 5*b*, and 5*c* in the CL mode and separate from the inner peripheral surface of the intermediate transfer belt 7. At this time, the separation roller 19 moves to the upper position, which corresponds to a second position, whereby the projection portions e3 come close to the swinging plate 26, and a range of motion ST5 of the belt automatic center adjustment mechanism 17U is smaller than the range of motion ST4 (ST5<ST4).

FIG. 11C illustrates the intermediate transfer unit 20 in an all-separation mode. The black primary transfer roller 5*d* further moves to an upper position higher than the position of the primary transfer roller 5*d* in the BK mode and separates from the inner peripheral surface of the intermediate transfer belt 7, and the intermediate transfer belt 7 becomes able to be attached or detached. At this time, the separation roller 19 remains held at the upper position, and a range of motion ST6 of the belt automatic center adjustment mechanism 17U has substantially the same value as the range of motion ST5 in the BK mode (ST6=ST5).

As described above, also in the present exemplary embodiment, the swinging range of the steering roller 17 is more restricted by the projection portions e3, which are provided as part of the separation mechanism 30B, in a case where the separation roller 19 is at the upper position than in a case where the separation roller 19 is at the lower position. In other words, the swinging range of a steering member is more restricted by the operations of the projection portions e3 as the restriction portions in a case where the roller member is at the second position than in a case where the roller member is at the first position. Consequently, in the intermediate transfer unit 20 having a plurality of stretching forms in which the position of the separation roller 19 varies, it is possible to reduce a change in the alignment of a stretching roller with a simple configuration. Then, in a case where the intermediate transfer belt 7 is replaced, it is possible to prevent the intermediate transfer belt 7 and the belt automatic center adjustment mechanism 17U from being damaged by inadvertent swings of the steering roller 17 and the swinging plate 26.

The present exemplary embodiment has been described on the assumption that the swinging ranges of the steering roller 17 in the BK mode and the all-separation mode are substantially equivalent to each other (ST5=ST6). However, the swinging range in the all-separation mode may be at least less than or equal to the swinging range in the BK mode.

Other Exemplary Embodiments

The intermediate transfer unit 20 according to each of the first and second exemplary embodiments is an example of the belt conveying device. Alternatively, as another example of the belt conveying device, a sheet conveying device for conveying a sheet as a recording material by a belt member, or a fixing device for heating a recording material via a belt member can be employed. This technique is applicable to also such a device so long as the device includes a roller member capable of changing the stretched form of a belt member, and a swingable steering roller for controlling the deviation of the belt member.

The projection portions e2 and e3 are examples of the restriction portions provided in the movement mechanism. Alternatively, another shape may be employed so long as the configuration is such that the swinging range of a steering roller can be restricted. Yet alternatively, the projection portions e2 and e3 may be members different from the separation roller bearings 29*e*. For example, the configuration may be such that in FIGS. 7A to 7C, projection portions extending rightward in FIGS. 7A to 7C from the swinging plate 26 are provided, and the upper surfaces of the separation roller bearings 29*e* as restriction portions are opposed to the projection portions. As another example, the configuration may be such that a portion having a shape (a pin or a recessed shape) allowing the portion to be engaged with the swinging plate 26 is provided in each separation slider 30 or 34, and if the separation slider 30 or 34 moves to a position corresponding to the all-separation mode, the portion becomes engaged with the swinging plate 26.

Further, the separation roller 19 is an example of the roller member around which the belt member is stretched. In a case where restriction portions are placed in bearing members of a roller member, bearing members of a roller member other than a separation roller may be used. For example, the roller member may be a primary transfer roller. Further, in the first and second exemplary embodiments, the separation roller 19 abuts the inner peripheral surface of the intermediate transfer belt 7 at both the first and second positions. Alternatively, a roller member that separates from the inner peripheral surface of the belt member at the second position may be used. Further, the primary transfer rollers 5*a* to 5*d* are examples of a plurality of transfer rollers, and the arrangement order of the primary transfer rollers 5*a* to 5*d* is not limited to the above. Further, for example, a transfer roller corresponding to an image forming unit for forming a gloss image using transparent toner may be included.

Further, in both the first and second exemplary embodiments, the belt automatic center adjustment mechanism 17U that is a passive steering mechanism for operating by frictional forces from the intermediate transfer belt 7 has been described. Instead of such a belt automatic center adjustment mechanism, an active steering mechanism for swinging a steering roller using an actuator may be used. Also in this case, as part of a movement mechanism, restriction portions capable of restricting the swinging range of the steering roller are placed, whereby it is possible to obtain effects similar to those of the above exemplary embodiments.

According to the belt conveying device according to the present disclosure, it is possible to restrict an inadvertent swing of a steering roller with a versatile configuration.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2017-042931, filed Mar. 7, 2017, which is hereby incorporated by reference herein in its entirety.

What is claimed is:

1. A belt unit attachable to and detachable from an image forming apparatus comprising:

an endless belt;

a steering mechanism including a first roller around which the belt is stretched, the steering mechanism capable of swinging the first roller about a swing axis intersecting an axial direction of the first roller;

a second roller around which the belt is stretched, and movable to a first position and a second position;

a frame configured to movably support the second roller; and a movement mechanism provided to be movable relative to the frame and configured to move the second roller, wherein the movement mechanism includes a restriction portion configured to restrict a swing of the first roller, and in a case where the second roller is at the first position, the first roller is provided to be swingable in a first predetermined range, and in a case where the second roller is at the second position, the restriction portion restricts the swing of the first roller within a second predetermined range smaller than the first predetermined range by contacting the steering mechanism.

2. The belt unit according to claim 1, wherein the belt unit further comprises a transfer roller configured to transfer a toner image onto the belt, and wherein the second roller is provided downstream of the first roller and upstream of the transfer roller in a rotational direction of the belt.

3. The belt unit according to claim 1, wherein in a case where a toner image is transferred onto the belt, the second roller is at the first position, and in a case where the belt unit is attached to or detached from the image forming apparatus, the second roller is at the second position.

4. The belt unit according to claim 1, wherein the second roller is a transfer roller configured to transfer a toner image onto the belt.

5. The belt unit according to claim 1, wherein the steering mechanism includes a supporting member configured to rotatably support the first roller, and a supporting shaft configured to support the supporting member to be swingable about the swing axis, and the restriction portion abuts the supporting member, thereby restricting the swing of the first roller.

6. The belt unit according to claim 1, wherein the movement mechanism includes a bearing member configured to rotatably support the second roller, and the restriction portion is provided in the bearing member.

7. The belt unit according to claim 1, wherein the first roller includes a driven portion capable of being driven with the belt, and friction portions provided on both sides of the driven portion, restricted from moving with the belt, and capable of coming into sliding contact with an inner peripheral surface of the belt, and the first roller swings by frictional forces applied to the friction portions by the belt according to rotation of the belt.

8. A belt unit attachable to and detachable from an image forming apparatus comprising:

a rotatable belt;

a transfer roller configured to transfer a toner image onto the belt;

a steering mechanism comprising:

a steering roller being rotatably supported and configured to stretch the belt;

receiving members which are contactable with the belt and provided at both ends of the steering roller, the receiving members receive force from the belt when contacted with the belt; and a supporting member configured to inclinably support the steering roller and the receiving members, wherein, in a case where the belt deviates to either one side in the width direction of the belt, the steering mechanism makes the steering roller incline in a direction to make the belt to move toward the other side in the width direction of the belt according to the force received by the receiving members from the belt; and a stretching roller configured to stretch the belt, wherein the stretching roller is rotatably provided downstream of the steering roller and upstream of the transfer roller in the rotational direction of the belt; and a moving mechanism to move the stretching roller by being transmitted with a driving force, wherein the moving mechanism is configured to move the stretching roller to a first position when forming an image, and to a second position when detaching the belt unit from the image forming apparatus, wherein the moving mechanism includes a restriction portion configured to restrict a position of the steering mechanism and when the stretching roller is at the first position, the restriction portion is outside a movable range of the steering mechanism when the belt is driven, and abuts to the steering mechanism when positioning at the second position.

9. The belt unit according to claim 8, wherein when the moving mechanism is in the second position, the restriction portion abuts against the supporting member and restricts the position of the steering mechanism.

10. The belt unit according to claim 8, wherein the restriction portion is provided to a bearing member of the stretching roller.

11. The belt unit according to claim 8, wherein the steering mechanism includes a slider slidable inside the belt, the slider is provided to the both ends of the steering roller and swingable in conjunction with the steering roller and is restricted from rotating together with the belt, and wherein the steering roller is swingable by frictional force received by the slider from the belt.

12. The belt unit according to claim 8, wherein tension of the belt is smaller when the moving mechanism is at the second position than that when the moving mechanism is at the first position.

13. The belt unit according to claim 8, wherein the moving mechanism is positioning at the first position when forming a full-color image, and positioning at a third positon when forming a monochrome image.

14. A belt unit attachable to and detachable from an image forming apparatus comprising:

a rotatable belt;

a transfer roller configured to transfer a toner image onto the belt;

a steering mechanism comprising:

a steering roller being rotatably supported and configured to stretch the belt;

receiving members which are contactable with the belt and provided at both ends of the steering roller, the receiving members receive force from the belt when contacted with the belt; and a supporting member configured to inclinably support the steering roller and the receiving members, wherein, in a case where the belt deviates to either one side in the width direction of the belt, the steering mechanism makes the steering roller incline in a direction to make the belt to move toward the other side in the width direction of the belt according to the force applied by the belt and received by the receiving members;

a stretching roller configured to stretch the belt, wherein the stretching roller is rotatable and stretches the belt at the position downstream of the steering roller and upstream of the transfer roller in the rotational direction of the belt; and a moving mechanism configured to move the stretching roller to a first position when forming an image, and to a second position when detaching the belt unit from the image forming apparatus by being transmitted with a driving force, wherein the moving mechanism includes a restriction portion configured to restrict a position of the steering mechanism, when the moving mechanism is at the first position, the restriction portion is outside a movable range of the steering mechanism when the belt is driven, and when the moving mechanism is at the second position, the restriction portion regulates the movable range of the steering mechanism when the driving of the belt is stopped.

15. The belt unit according to claim 14, wherein when the moving mechanism is at the second position, the restriction portion is abuttable against the supporting member.

16. The belt unit according to claim 14, wherein the restriction portion is provided to the bearing member of the stretching roller.

17. The belt unit according to claim 14, wherein the receiving members are restricted from rotating together with the belt and comprises the slider which is slidable inside the belt, wherein the steering roller inclines according to the frictional force received by the slider from the belt.

18. The belt unit according to claim 14, wherein tension of the belt is smaller when the moving mechanism is at the second position than that when the moving mechanism is at the first position.

19. The belt unit according to claim 14, wherein the moving mechanism is at the first position when forming a full-color image, and the moving mechanism is at a third position when forming a monochrome image.

* * * * *